US005248182A

United States Patent [19]

Hittie

[11] Patent Number: 5,248,182

[45] Date of Patent: Sep. 28, 1993

[54] CHAIR BODY SUPPORT

[76] Inventor: Debra A. Hittie, R.D. #1, Box 47B, Friedens, Pa. 15541

[21] Appl. No.: 981,433

[22] Filed: Nov. 25, 1992

[51] Int. Cl.[5] ..... A47C 7/42

[52] U.S. Cl. ..... 297/230.1; 297/397; 297/464; 297/460

[58] Field of Search ..... 5/633, 653; 297/397, 297/464, 486, 460, 230, 231

[56] References Cited

U.S. PATENT DOCUMENTS

| | | | |
|---|---|---|---|
| 1,673,433 | 6/1928 | Wheeler et al. | 297/231 |
| 3,542,421 | 11/1970 | Ambrose | 297/230 |
| 5,154,477 | 10/1992 | Lacy | 297/397 |

FOREIGN PATENT DOCUMENTS

| | | | |
|---|---|---|---|
| 1101008 | 9/1955 | France | 297/231 |
| 448358 | 6/1936 | United Kingdom | 297/397 |
| 766553 | 1/1957 | United Kingdom | 297/460 |
| 838118 | 6/1960 | United Kingdom | 297/397 |
| 990112 | 4/1965 | United Kingdom | 297/464 |

*Primary Examiner*—Michael F. Trettel
*Attorney, Agent, or Firm*—Gregory J. Gore

[57] ABSTRACT

A padded seat cushion support consists of large, vertical side cushions having extremely full and soft padding. When installed on a chair, such as a wheelchair, the cushions grip the sides of the occupant, including both sides of the occupant's head. The vertical side cushions are affixed to a central fabric panel which is fastened to the inside chair seat back by straps and also by a pocket at the rear of the panel which receives the top of the chair seat back. The vertical side cushions are slanted inward along the central panel to a top end of the panel where they are held on either side of the patient's head, thereby comfortably supporting the patient's head against unwanted lateral deflection.

3 Claims, 2 Drawing Sheets

CHAIR BODY SUPPORT

FIELD OF THE INVENTION

This invention relates to a chair support for comfortably restraining head and torso movement of a patient seated in the chair.

BACKGROUND OF THE INVENTION AND DESCRIPTION OF THE PRIOR ART

Patients who are confined to wheelchairs require means for body support to keep them from inadvertently falling to one side, or sliding out of the chair. Padded supports for wheelchair occupants are well-known. These include both wheelchair covers and individual small pillows which are stuffed between the patient and the side arms of the wheelchair to provide lateral support for the patient. For adequate restraint, sufficient grip between the padding, chair, and the patient is required, but lacking in the prior art supports. Furthermore, while most padded chair supports concentrate on limiting the lateral deflection of the torso of the patient, few employ means to restrain the movement of the patient's head.

There are several prior art supports for completely restraining the motion of the head and body of the patient, however, these are generally tightly fitting straps which are very uncomfortable and not designed for use by handicapped or senile patients who spend much of their time in wheelchairs. The various prior art cushions which utilize a plurality of belts and straps are extremely inconvenient for patients who must enter and exit the wheelchair many times during the day.

The closest prior art to the present invention of which the applicant is aware is U.S. Pat. No. 4,541,425, issued to Yetter, Jr., entitled "Head and Torso Restraint". This patent describes the system of individual side pillows which are attached to the wheelchair by straps. It further shows a strap-like head restraint for use in conjunction with the side support pillows; and, therefore, represents an assemblage of three individual parts. While these prior art supports are effective to some extent, they represent a cumbersome assembly of pieces which are difficult to use. Also, padded chair supports of this type can only be used with chairs having arms or side rails.

It is, therefore, an object of the present invention to provide, in combination with a wheelchair or other chair, means for restraining both the head and torso of a patient seated in the chair without the use of belts or straps, or similar devices which restrict the patient's freedom from entering and exiting the chair.

It is a further object of the present invention to provide a comfortable, padded chair restraint which supports the head and torso of the patient in the form of a one-piece, padded chair cover, easily installed on, or removed from the chair.

It is yet a further object of the present invention to provide a padded chair cover which supports the head and torso of the occupant, which is simple and inexpensive to manufacture, and easy to clean and maintain.

SUMMARY OF THE INVENTION

In order to overcome the deficiencies of the prior art described above and to achieve the various stated objects of the present invention, a unique padded seat cushion support has been devised. The present invention consists of a unique configuration of cushions having extremely full and soft padding. The support is constructed so that when installed on a wheelchair with the occupant seated against the cushions, the padding bulges and grips those bodily areas where it is needed the most. This support includes both horizontal and vertical lateral support padding provided by two vertical side cushions which are attached to side edges of a central fabric panel affixed to the chair back.

The vertical side cushions are slanted inward along the central panel to a top end of the panel so that they fall close together on either side of the patient's head, thereby comfortably supporting the patient's head against unwanted lateral deflection. The dimension of each side cushion is widest laterally at the top, which gives increased support to the head of the patient. From the wide top, the side cushions taper laterally to a greatly reduced dimension at the bottom where the cushions meet the chair seat. Furthermore, the cushions of the present invention are dimensioned so as to create a depth sufficient to greatly increase the surface area of contact between the cushion and the patient. In this way, comfortable grip is provided between the padding and the patient without necessitating the use of straps or belts to securely hold the patient's head and torso.

More specifically, the applicant has invented a chair body support to provide head and torso restraint for a patient seated therein, comprising: a panel with means to affix the panel to the chair along the inside surface of the chair back; a pocket at the top and in the rear of the panel which receives the top of the chair back when installed on the chair; a pair of vertically-extending side cushions, each being affixed to the panel along a pair of seams at vertical side edges of the panel, each cushion having an internal volume which decreases toward the bottom of the panel and increases toward the top so that each cushion has a wide and full lateral cross-section at the top and a narrow lateral cross-section at the bottom, the panel being narrower at the top and the cushions being spaced closest together at the top where their lateral cross-section is the greatest. The means to affix the chair body support to the chair include aperture means at the bottom of the panel for receiving straps which affix the panel to the chair back. The cushions are dimensioned with respect to a person seated in the chair, such that the top of the cushions contact and support the head of the person laterally.

Because the present invention is a one-piece design, it is easily installed or removed from the chair. Unless complete restraint is desired, no belts or straps are used around the body of the patient; hence, the chair occupant is free to exit and enter the chair without encumbrance. Other objects and advantages of the present invention will be readily understood from the following drawings and detailed description of the preferred embodiment.

DESCRIPTION OF THE PREFERRED EMBODIMENT

Figure 1:
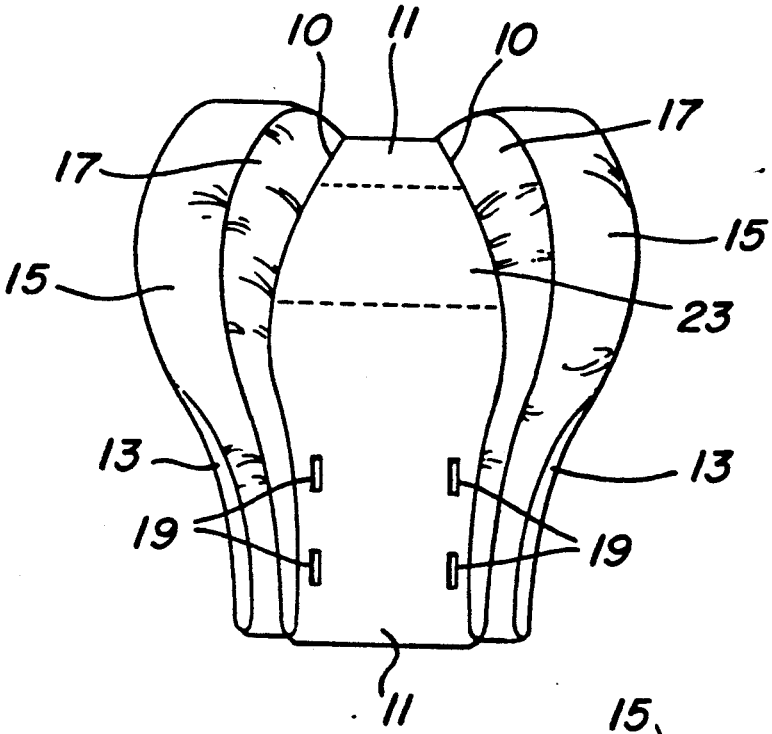
FIG. 1 is a front isometric view of the present invention.
Figure 1A:
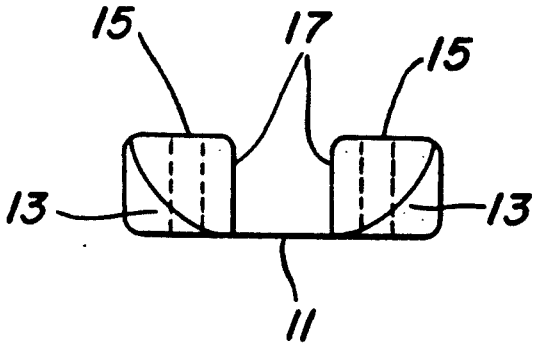
FIG. 1*a* is a top view of the present invention shown in FIG. 1.

Referring now to FIG. 1, the present invention is shown in isolation. The invention includes central fabric panel 11, which includes apertures 19 for receiving straps which pass therethrough and affix the panel to the inside back of the wheelchair. It will be understood that the same straps may also be fitted around the torso of the patient if additional restraint is desired. Pocket 23, which is formed from a separate piece of material affixed to the back of the central panel, receives the top of the chair back as more clearly shown in FIGS. 3 and 4. Two identical right and left vertical side cushions are affixed to opposite side edges of the central panel along seams 10. Central panel 11 narrows toward the top and the bottom with a wider midsection, which is intended to fall in the area of the shoulders of the patient. FIG. 1*a* is a top view of the present invention shown in FIG. 1.

Figure 2:
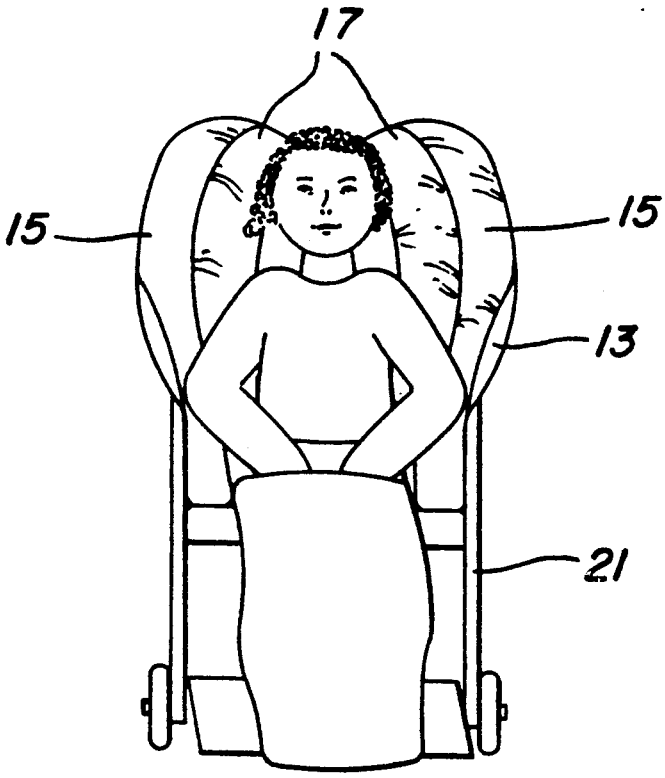
FIG. 2 is a front view of the present invention installed on a wheelchair with an occupant seated therein.

Referring now to FIG. 2, the present invention is shown installed in a wheelchair 21 occupied by a patient. Each cushion is composed of three pieces of fabric; an inside 17, a front 15, and an outside 13 piece. When sewn together these pieces create cushions having an internal volume, which is stuffed with soft padding. Along the top of inside piece surfaces 17, the cushions provide a full and soft support to the patient's head on either side. Front pieces 15 are wider at the top so that the volume of each side cushion increases toward the top to provide head support. And viewed from the front, this provides a narrow tapered portion at the bottom of each cushion which falls between the patient's hips and the wheelchair side arms. It can be readily seen in this figure that the patient is adequately supported laterally and that the cushions on either side at the top contact the head of the patient, providing lateral support of the head.

Figure 3:
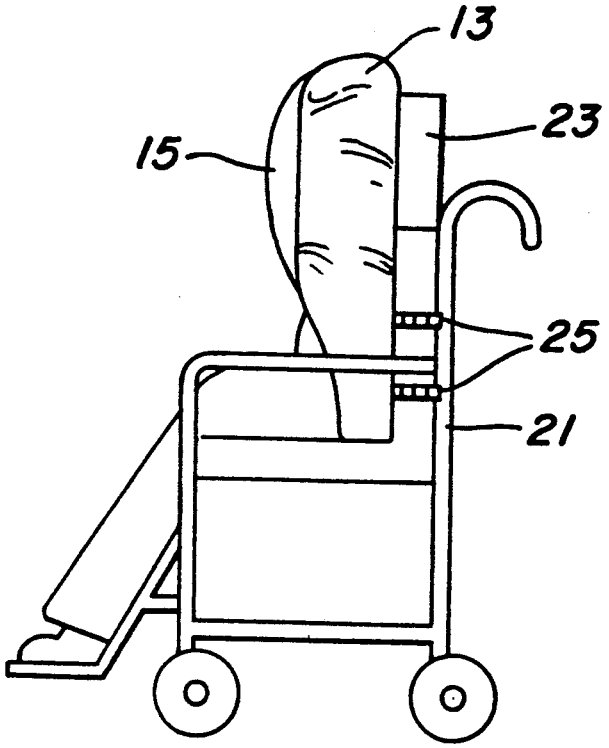
FIG. 3 is a side view of the present invention installed on a wheelchair and occupied as shown in FIG. 2.

Referring now to FIG. 3, a side view of the invention as shown in FIG. 2 is depicted. It can be seen from this figure that the outside cushion pieces 13, like piece 17 and 15, also taper from top (wide) to bottom (narrow) so that each side cushion projects forward from the back of the wheelchair beyond the front of the patient's head. As shown in this figure, pocket 23 is formed by an additional piece of fabric which is affixed to the rear of the central panel. This pocket accepts the top of the chair back to help secure the support to the chair. Belts 25 which pass through the apertures in the central panel, more clearly depicted in FIG. 1, also secure the present support cushion to the back of the chair.

Figure 4:
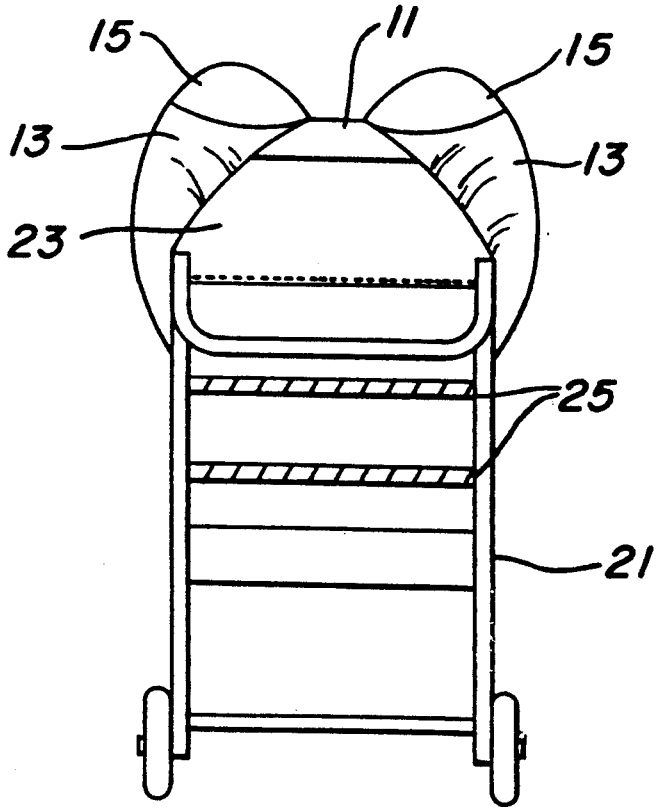
FIG. 4 is a rear view of the present invention installed on an occupied wheelchair as shown in FIG. 3.

Referring now to FIG. 4, a rear view of the occupied chair shown in FIG. 3 is depicted. Belts 25 which pass around the back of the wheelchair affix the seat cushion support of the present invention thereto. As clearly shown in this figure, rear pocket 23 accepts the top of the wheelchair back, thus securing the upper portion of the panel and cushions to the wheelchair.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A chair body support to provide head and torso restraint for a patient seated therein, comprising:
   - a panel with means to affix said panel to the chair along the inside surface of the chair back;
   - a pocket at the top and in the rear of said panel which receives the top of the chair back when installed on the chair;
   - a pair of vertically-extending side cushions, each being affixed to said panel along a pair of seams at vertical side edges of the panel, each cushion having an internal volume which decreases toward the bottom of the panel and increases toward the top so that each cushion has a wide and full lateral cross-section at the top and a narrow lateral cross-section at the bottom; and
   - said panel being narrower at the top and said cushions being spaced closest together at the top where their lateral cross-section is the greatest.

2. The chair body support of claim 1, wherein said means to affix said to said chair includes aperture means at the bottom of said panel for receiving straps which affix the panel to the chair back.

3. The chair body support of claim 2, wherein said cushions are dimensioned with respect to a person seated in said chair such that the top of said cushions contact and support the head of the person laterally.

* * * * *